US007230473B2

(12) United States Patent
Tadeparthy et al.

(10) Patent No.: US 7,230,473 B2
(45) Date of Patent: Jun. 12, 2007

(54) PRECISE AND PROCESS-INVARIANT BANDGAP REFERENCE CIRCUIT AND METHOD

(75) Inventors: Preetam Charan Anand Tadeparthy, Bangalore (IN); Ankit Seedher, Bangalore (IN)

(73) Assignee: Texas Instruments Incorporated, Dallas, TX (US)

( * ) Notice: Subject to any disclaimer, the term of this patent is extended or adjusted under 35 U.S.C. 154(b) by 112 days.

(21) Appl. No.: 10/908,222

(22) Filed: May 3, 2005

(65) Prior Publication Data

US 2006/0208790 A1 Sep. 21, 2006

(30) Foreign Application Priority Data

Mar. 21, 2005 (IN) ..... 292/CHE/2005

(51) Int. Cl.
*G05F 1/575* (2006.01)
*G05F 1/567* (2006.01)

(52) U.S. Cl. ..... 327/539; 323/314

(58) Field of Classification Search ..... 327/539; 323/313–314

See application file for complete search history.

(56) References Cited

U.S. PATENT DOCUMENTS 5,739,681 A * 4/1998 Allman ..... 323/314
6,329,804 B1 * 12/2001 Mercer ..... 323/315
6,737,908 B2 * 5/2004 Mottola et al. ..... 327/539
6,844,711 B1 * 1/2005 Sutardja et al. ..... 323/314
7,012,416 B2 * 3/2006 Marinca ..... 323/316
2005/0237045 A1 * 10/2005 Lee et al. ..... 323/313
2005/0285666 A1 * 12/2005 Garlapati et al. ..... 327/539

OTHER PUBLICATIONS

Perry Miller and Doug Moore; "Precision voltage references", Analog Applications Journal Nov. 1999; pp. 1-4; Texas Instruments, Dallas.

Tao Li, Bhaskar Mitra, and Kabir Udeshi ; "A Low Voltage Bandgap Reference Circuit with Current Feedback"; EECS 413 Project, University of Michigan Department of Electrical Engineering and Computer Science, Michigan; Downloaded from http://www.eecs.umich.edu/~mpflynn/Design_Contest/Fall2003/Reports/kabir_bhaskar_tao.pdf, pp. 1-5.

"Bandgap Reference Trimming Procedure", from the Bandgap Reference Generator; Aug. 5, 1999; Downloaded from http://www.orion-design.com/boost/bandgap_trim.pdf , Orion Design Technologies, Inc. (4 Pages).

* cited by examiner

*Primary Examiner*—Kenneth B. Wells
*Assistant Examiner*—Terry L. Englund
(74) *Attorney, Agent, or Firm*—Steven A. Shaw; W. James Brady; Frederick J. Telecky, Jr.

(57) ABSTRACT

A voltage generation circuit generates a reference voltage using a bandgap reference. A countering circuit is included to adaptively counter for any deviations caused in a bandgap reference voltage such that the reference voltage is independent of fabrication process variations and changes in ambient temperature. In an embodiment, current, proportionate to deviation in absolute value of Vbe from a nominal value, is injected into an emitter-base junction to cause Vbe to equal the nominal value.

18 Claims, 5 Drawing Sheets

PRECISE AND PROCESS-INVARIANT BANDGAP REFERENCE CIRCUIT AND METHOD

RELATED APPLICATION

The present application is related to and claims priority from co-pending India Patent Application Serial Number: 292/CHE/2005, Entitled, "Precise and Process-Invariant Bandgap Reference Circuit and Method", filed: 21 Mar. 2005, naming the same inventors as in the subject application, and is incorporated in its entirety herewith.

BACKGROUND OF THE INVENTION

1. Field of the Invention

The present invention relates design of integrated circuits, and more specifically to a method and apparatus which generates an invariant (constant/fixed) and pre-specified (nominal or desired) voltage independent of fabrication process variations and changes in ambient temperature.

2. Related Art

Reference voltages are often generated using techniques, which produce a fixed voltage based on the bandgap voltage of silicon. In some prior embodiments, these reference voltages are generated by adding a term with a positive temperature coefficient (typically generated as a difference of base-emitter voltages of two bipolar junction transistors with unequal current densities) and the base-emitter voltage of a bipolar junction transistor. This reference voltage approaches the bandgap voltage of Silicon as the absolute temperature approaches 0 K, hence is called bandgap reference.

There is a recognized need that the reference voltage equal a pre-specified (desired/nominal) voltage, in addition to being invariant (does not change over time) in various operating conditions (e.g., fabrication process and ambient temperature). Example environments where such a need exists include, without limitation, analog-to-digital converters (ADCs), regulators, etc.

One known reason for a reference voltage to deviate from a pre-specified voltage is variations typically encountered in fabrication processes. In general, the variations lead to corresponding variations in the voltage level across the junction (providing the bandgap reference during operation), which may reflect in the reference voltage sought to be generated.

In one prior approach, components such as fuses and/or resistor networks are used, which can be configured (blowing the fuses or trimming the resistance) to ensure that the reference voltage equals a pre-specified value. However, such an approach generally leads to several disadvantages such as increase in the overall cost of the products (since the approach requires testing to determine the deviations from the pre-specified value), requiring additional area on the fabricated integrated circuit, etc.

What is therefore needed is a method and apparatus which generates an invariant (constant/fixed) and pre-specified (nominal or desired) voltage while meeting at least some of the requirements noted above.

BRIEF DESCRIPTION OF THE DRAWINGS

The present invention will be described with reference to the following accompanying drawings, which are described briefly below.

In the drawings, like reference numbers generally indicate identical, functionally similar, and/or structurally similar elements. The drawing in which an element first appears is indicated by the leftmost digit(s) in the corresponding reference number.

DETAILED DESCRIPTION

1. Overview

A reference generation circuit provided according to an aspect of the present invention adaptively (without requiring any configuration or automatically) generates a pre-specified reference voltage using a bandgap reference irrespective of the variations in fabrication process. In an embodiment, such a feature is attained by the use of a countering circuit which generates an electrical signal representing change in the voltage across the junction due to the variations in fabrication process, and using the electrical signal to correct the reference signal provided. The countering circuit may also be used to correct the reference signal due to changes in ambient temperature, thereby ensuring that the reference voltage is invariant with ambient temperatures as well. In an embodiment described below, the reference signal corresponding to a voltage signal is generated and the reference generation circuit is referred to as a voltage generation circuit.

Several aspects of the invention are described below with reference to examples for illustration. It should be understood that numerous specific details, relationships, and methods are set forth to provide a full understanding of the invention. One skilled in the relevant art, however, will readily recognize that the invention can be practiced without one or more of the specific details, or with other methods, etc. In other instances, well known structures or operations are not shown in detail to avoid obscuring the features of the invention.

2. Example Device

Figure 1:
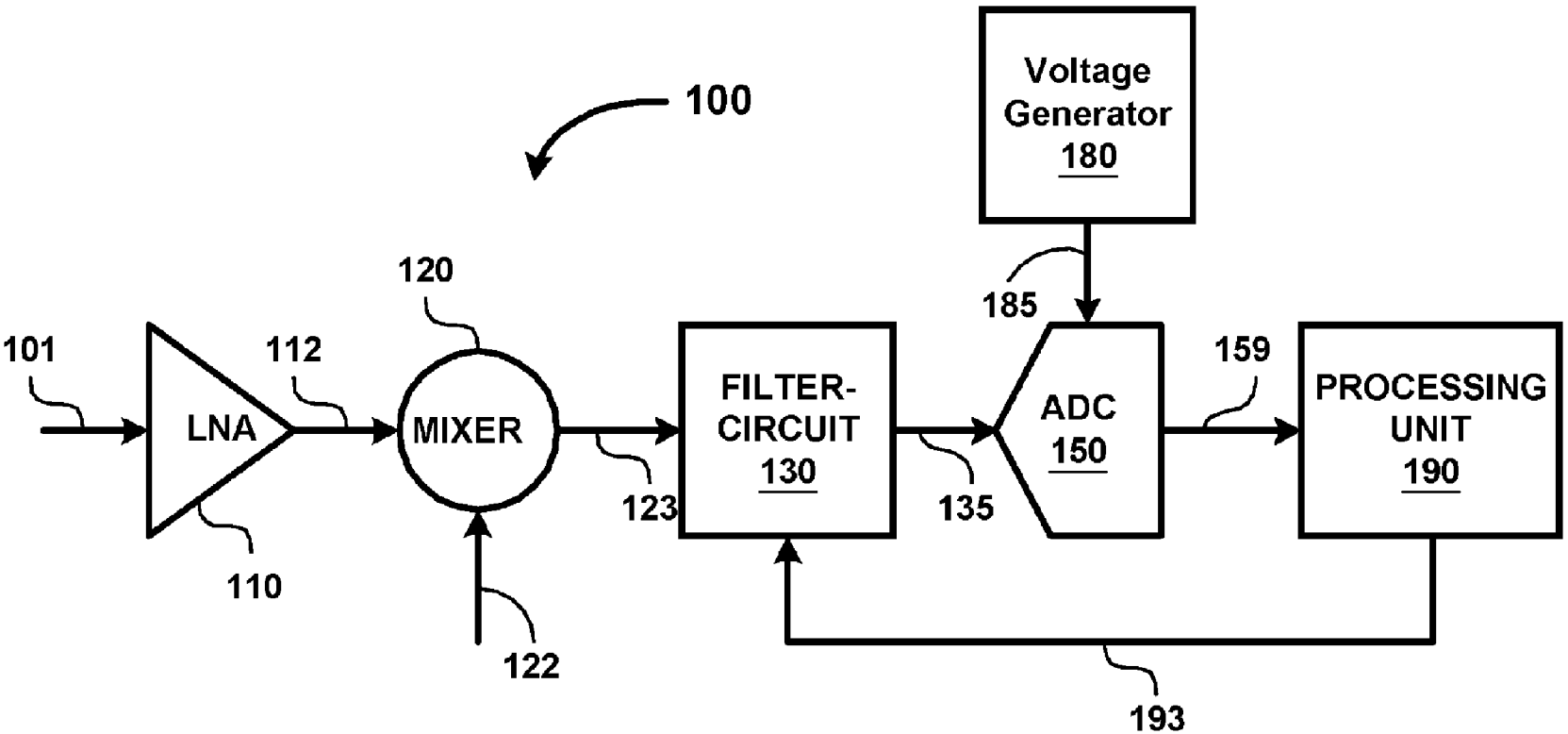
FIG. 1 is a block diagram of an example device in which various aspects of the present invention are implemented.

FIG. 1 is a block diagram illustrating an example device in which several aspects of the present invention are implemented. For illustration, it is assumed that receiver system 100 is implemented within a Wireless Local Area Network (WLAN) Receiver. However, receiver system 100 can be implemented in other devices (wireless as well as wire_based communications) as well.

Receiver system 100 is shown containing low noise amplifiers (LNA) 110, mixer 120, filter circuit 130, analog to digital converter (ADC) 150, voltage generation circuit 180, and processing unit 190. Each block/stage is described in further detail below.

LNA 110 receives signals on path 101 and amplifies the received signals to generate a corresponding amplified signal on path 112. For example, in wireless systems, the signals that are transmitted from satellites, etc. may be received by an antenna (not shown) and the received signals are provided on path 101. The received signals may be weak in strength and thus amplified by LNA 110 for further processing.

Mixer 120 may be used to down_convert the received amplified signal on path 112 into an intermediate signal with the frequency band of interest centered at a lower frequency than the carrier frequency of the received signal. In an embodiment, a signal with the frequency band of interest centered at 2.4 GHZ (carrier frequency) is converted to a signal with the frequency band of interest centered at zero frequency.

Mixer 120 may receive the amplified signal on path 112 and a signal of fixed frequency on path 122 as inputs, and provides the intermediate signal on path 123. The signal on path 122 of fixed frequency may be generated by a phase locked loop (not shown) in a known way.

Filter circuit 130 may perform both filtering and amplification operations. The desired amplification factor may be received on path 193. The filtering operation passes only the desired frequency components. Filter circuit 130, LNA 110 and mixer 120 may be implemented in a known way.

Processing unit 190 processes the digital values received on path 159, and also measures/estimates the strength of the received signal. Processing unit 190 generates signal on path 193 representing the amount of amplification required based on the measurement.

ADC 150 converts (samples) the filtered signal received on path 135 to corresponding digital values on path 159. The digital values represent the signal of interest in received signal 101. The reference voltage received on path 185 is used while performing the conversion.

Voltage generation circuit 180 generates a reference voltage using a voltage present across a junction, and the generated voltage is provided on path 185. In general, the reference voltage needs to be fixed and equal a pre-specified value for accurate operation of ADC 150. The reference voltage may not meet such requirements in several situations (e.g., process variation and changes in ambient temperatures), as noted above in the Background Section.

The manner in which voltage generation circuit 180 can be implemented to adaptively generate fixed and pre-specified reference voltage even in the presence of above situations according to various aspects of the present invention, is described in further detail below. Some of the features of the present invention may be clearer in comparison to a prior circuit. Accordingly, the prior circuit is described below.

3. Prior Voltage Generation Circuit

Figure 2:
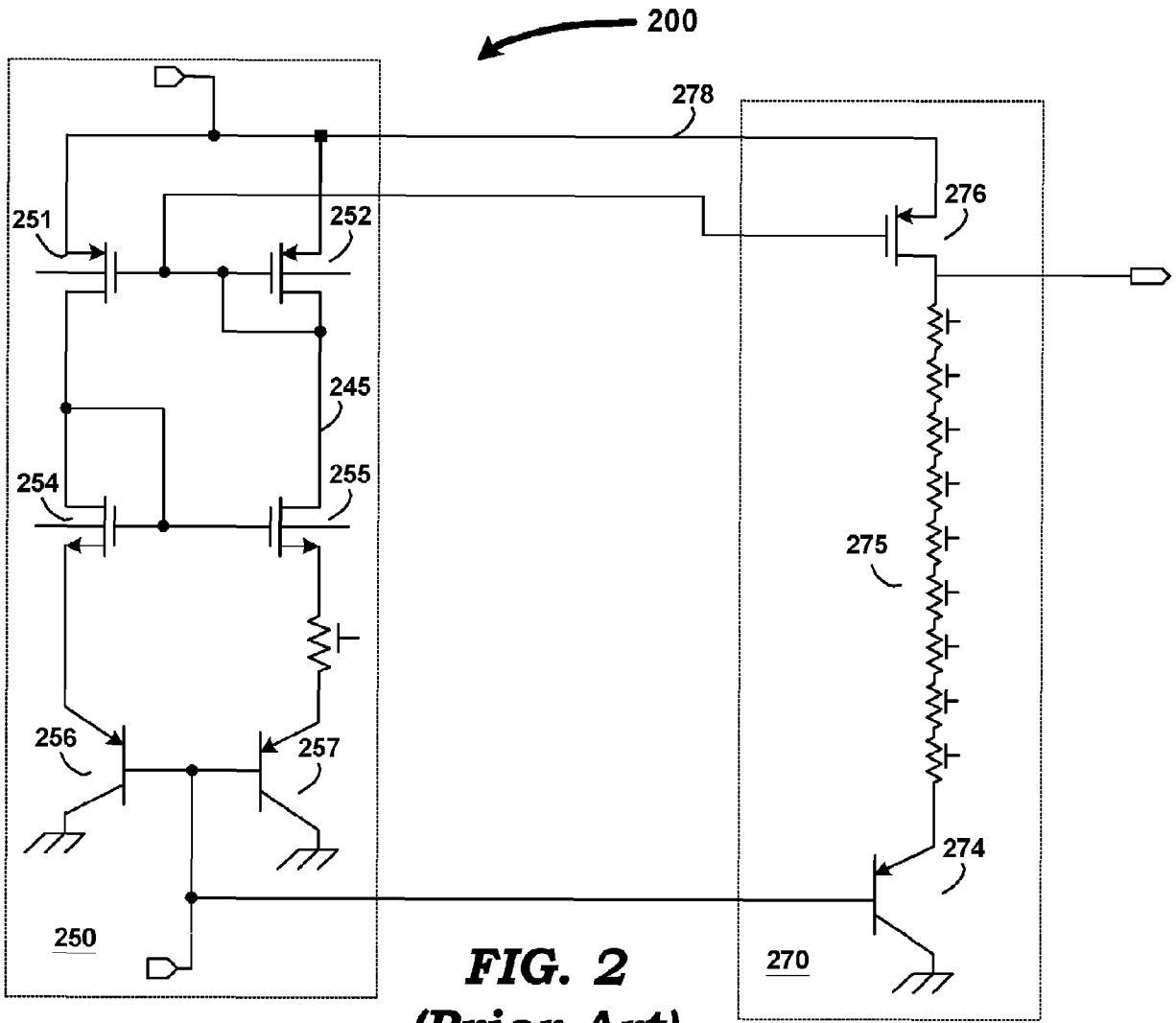
FIG. 2 (Prior Art)
FIG. 2 is a circuit diagram illustrating the details of a prior voltage generation circuit.

FIG. 2 is a circuit diagram illustrating the details of a prior voltage generation circuit in one embodiment. Voltage generation circuit 200 is shown containing PTAT (proportional to absolute temperature) generator 250, and final stage 270. Each component is described below in further detail.

PTAT generator 250 provides PTAT current (on path 245) with a magnitude having positive correlation with the ambient temperature. Briefly, the combination of transistors 254, 255, 251, 252, 256 and 257 provides a current (on path 245) which is proportionate to (Vbe1−Vbe2), wherein Vbe1 and Vbe2 respectively represent the base-to-emitter voltages of transistors 256 and 257.

Bipolar transistors 256 and 257 have non-equal current densities such that the difference (Vbe1−Vbe2) is proportionate to the ambient temperature, and thus the current generated on path 245 is proportionate (or has a positive correlation) to the ambient temperature. Transistors 252 and 276 operate to mirror the PTAT current to final stage 270 on path 278.

Final stage 270 is shown containing bipolar transistor 274, MOS transistor 276 and resistor network 275. The reference voltage (Vref) equals the base-to-emitter (voltage present across a junction) voltage Vbe of transistor 274 plus the voltage drop across resistor network 275 due to PTAT current on path 278. The bandgap reference of the silicon (implementing the transistor 274) contributes to Vbe (which in turn contributes to the reference voltage generated according to various aspects of the present invention). The manner in which the components are operated to provide fixed and pre-specified reference voltage in the context of variations in ambient temperature and process variations, is described below.

With respect to countering the effects due to changes in ambient temperature, the base-emitter voltage Vbe has a negative correlation with the ambient temperature. However, as the PTAT current has a positive correlation (which proportionately changes the voltage drop across resistor network 275) with ambient temperature, the changes in reference voltage due to temperature changes are compensated by the voltage drop, thereby maintaining a constant reference voltage even if the ambient temperature changes.

With respect to countering the effects due to process variations, resistor network 275 is implemented with the ability to be trimmed. Each integrated circuit fabricated is tested to determine the degree of variation of the absolute reference voltage from a desired value, and resistor network 275 is trimmed to counter the deviation from the desired value.

One problem with the trimming based approach is that it typically requires additional components such as switches and fuses to trim the resistor network, which adds to the space requirements. Accordingly, such an approach may not be acceptable in several environments. Specifically, such an approach adds to the overall cost of products since it may require expensive test time in addition to increasing the area of the circuit.

Various aspects of the present invention enable a voltage generation circuit to be implemented while overcoming at least some of the deficiencies noted above. First the principle underlying the approach in an embodiment is described below.

4. Principle

Figure 3:
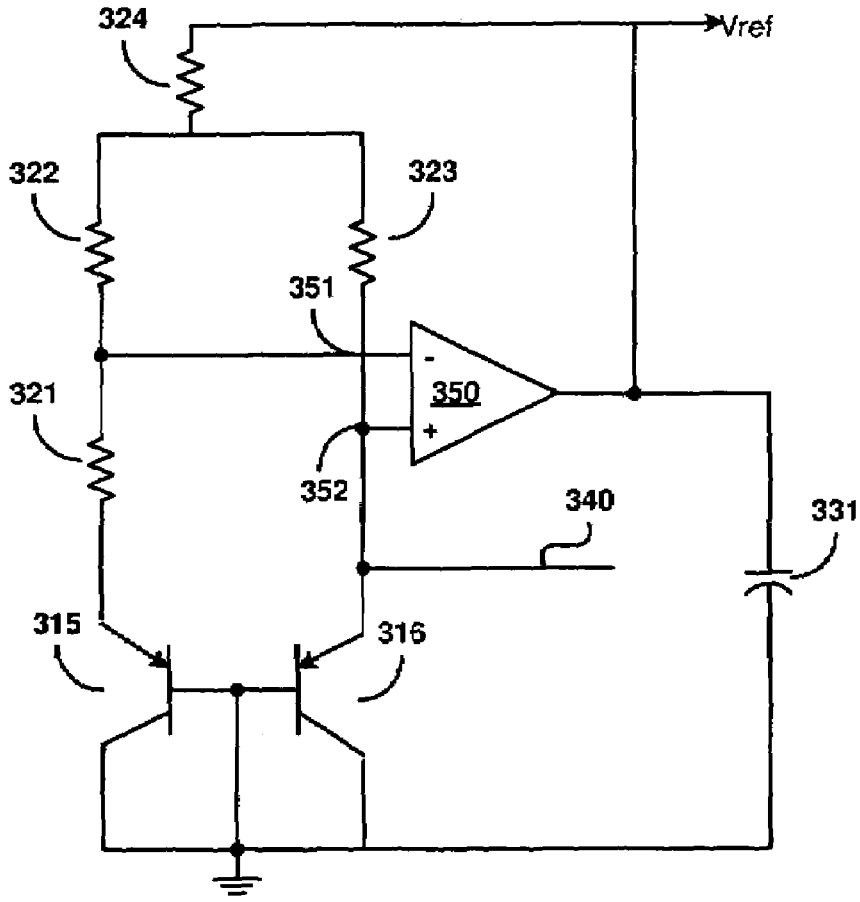
FIG. 3 is a circuit diagram illustrating the principle underlying the manner in which a fixed pre-specified voltage is generated according to an aspect of the present invention.

FIG. 3 is a circuit diagram illustrating the principle underlying the generation of a fixed and pre-specified voltage using bandgap reference in an embodiment of the present invention. The circuit is shown containing resistors 321-324, bipolar transistors 315-316, capacitor 331 and operational amplifier 350. Each component is described below in further detail.

One of the terminals of resistors 321 is connected to inverting terminal of operational amplifier 350, and the other terminal to emitter of the transistor. One of the terminals of resistor 322 is connected to inverting terminal of operational amplifier 350 and another terminal to one of the terminals of the resistor 324. Other terminal of resistor 324 is connected to the output of operational amplifier 350. Resistor 323 is connected between non-inverting terminal of operational amplifier 350 and a node formed by resistors 324 and 322.

Collector and base terminals of transistors 315 and 316 are connected to ground. The bandgap reference of silicon implementing transistors 315 and 316, contributes to respective Vbe, which in turn determines the desired reference voltage, as described below. Capacitor 331 is connected between the output of operational amplifier 350 and ground. Resistor 324 is also connected to the output of operational amplifier 350. Vref is provided at the output of operational amplifier 350. Vref can be generated to be fixed and of a pre-specified magnitude as described below.

It may be further appreciated that Vref equals voltage drop across resistors 323 and 324 plus Vbe. The manner in which each component affects the goal of generating fixed and pre-specified magnitude of the Vref is described below.

Amplifier 350 maintains nodes 351 and 352 at the same potential (virtual short) due to negative feedback action. Therefore this causes a current proportional to the difference between the base emitter voltages of bipolar transistors 315 and 316 to flow through resistors 321, 322, 323 and 324. This current is proportional-to-absolute-temperature (PTAT) current which causes a voltage drop (across these resistors) proportional to the absolute temperature. The voltage Vref, being the sum of voltage drop across resistors 323 and 324 and Vbe of transistor 316 is therefore invariant with changes in temperature.

From the above, it may be appreciated that process variations could alter Vbe (and thus Vref), and thus Vbe may deviate from a nominal pre-specified value. The deviation in Vbe in turn could cause deviations in Vref from a pre-specified magnitude. It may be appreciated that variations in the reference voltage due to process/fabrication/manufacturing imperfections is due to the variation of the base-emitter voltage Vbe with process. The PTAT term being proportional to the difference (Vbe1−Vbe2) is invariant with process. This is because the difference of two base-emitter voltages (biased at non-equal current densities) shall have the saturation currents of the two transistors appearing as a ratio. Therefore, the PTAT term is generally immune to process variations.

The immunity of the PTAT term to process variation is exploited to generate a voltage proportional to the PTAT (current). The voltage is used to sense the change in Vbe with process. Accordingly a correction mechanism is implemented to correct variation in Vbe, and in turn, to correct variation in the reference voltage Vref with fabrication process. The manner in which the deviations in Vref from pre-specified value are countered is described below with respect to the Vbe component of Vref.

With respect to Vbe component of Vref, an aspect of the present invention takes advantage of the recognition that the Vbe of a bi-polar transistor is dependent on the magnitude of the current flowing through base-emitter junction. Thus, the effects of process variations can be countered by injecting the appropriate amount of current (Icorrection) on path 340. This correction current Icorrection causes a change in Vbe in a direction opposite to the change due to process and therefore tries to restore it to it's nominal value. The manner in which Icorrection can be generated is described below with example circuits.

5. Exponential Countering Circuit

Figure 4:
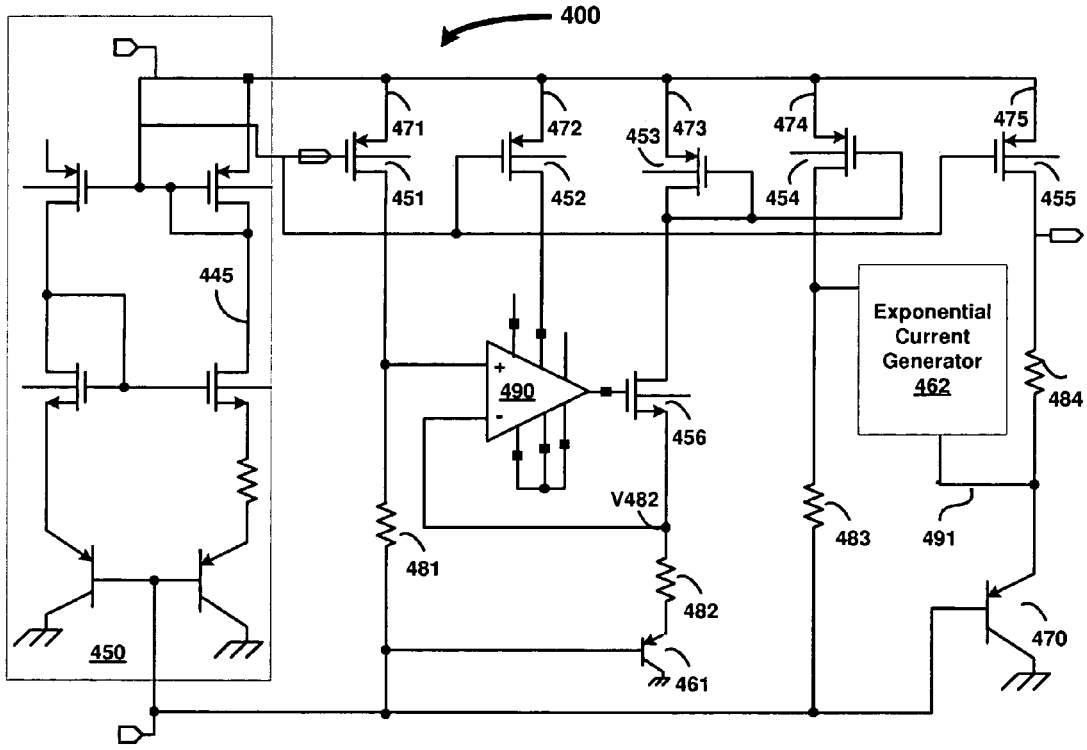
FIG. 4 is a circuit diagram illustrating the details of a voltage generation circuit in an embodiment of the present invention.

The desired magnitude of the current injected into base-emitter junction (Icorrection) is determined based on the recognition that Vbe is proportionate to In (Ij), wherein In represents the logarithmic operation, and Ij represents the aggregate current flowing through the base-emitter junction. FIG. 4 illustrates the details of an example circuit for the corresponding implementation.

Voltage generation circuit 400 is shown containing PTAT generator 450, operational amplifier 490, CMOS transistors 451-456, resistors 481-484, exponential current generator 462, bipolar transistors 461 and 470. Each component is described below in further detail.

PTAT generator 450 is implemented similar to PTAT generator 250, and is not described again for conciseness. As may be appreciated, PTAT generator 450 operates to generate a current whose variation is proportional to the changes in ambient temperature. Exponential current generator 462 generates an output current which is proportional to the exponent of the input voltage. One embodiment is implemented using a circuit which mimics the exponential response using a pseudo-exponential function implemented using a series summation or a ratio of polynomials. Several such circuits are well known in the relevant arts.

Transistors 451 and 455 operate to mirror the PTAT current (on path 445) generated by PTAT generator on paths 471-475 respectively. Transistor 452 provides bias current to operational amplifier 490. Transistors 461 and 456, exponential current-generator 462, resistors 481-483, and operational amplifier 490 operate as countering circuit, which generates a correction current (on path 491) exponentially proportional to deviation of absolute value of Vbe of transistor 470 from an nominal Vbe value. The operation of countering circuit is described below in further detail.

Broadly, transistor 461, resistors 481-482 and operational amplifier 490 operate to generate a voltage level (across resistor 483) proportionate to the deviation of the base-emitter voltage Vbe from a nominal value, and exponential-current generator 462 generates a current exponentially proportional to the voltage across resistor 483.

Resistor 481 causes a voltage level (Vptat) to be applied on the non-inverting terminal of operational amplifier 490. Vptat equals the PTAT current generated by PTAT current generator 450 multiplied by the resistance of resistor 481. Due to the negative feedback, amplifier 490 causes the voltage V482 to be equal to the PTAT voltage applied to its non-inverting terminal. Therefore a current proportional to the difference between a process-invariant PTAT voltage and a process-variant Vbe flows through resistor 482 and is mirrored to path 474 using transistors 453 and 454. Resistor 483 generates a voltage potential proportionate to current mirrored on path 474. The voltage across the resistor 483 is therefore proportional to the difference between the PTAT voltage and the base-emitter voltage Vbe of transistor 461. This voltage is applied as an input to exponential current-generator 462 and therefore a correction current is generated on path 491 that is exponentially proportional to this voltage.

As a result, any deviation in Vbe from a nominal Vbe value is reflected exponentially in Icorrection. The relation between Vbe and emitter current for a transistor (specifically transistor 470) being logarithmic in nature, the variation in Vbe of transistor 470, and therefore variation in output reference voltage due to it, are corrected for by various aspects of the present invention.

Thus, the countering circuit of above adaptively increases Icorrection when the absolute value of Vbe is less than the nominal value, and decreases Icorrection when the absolute value of Vbe is more than the nominal value. As a result, the Vbe is adaptively compensated for variations resulting from process variations, and thus Vref is generated with a fixed value irrespective of process variations.

One problem with the circuit of FIG. 4 is that the accuracy of compensation depends on the ideal logarithmic operation of exponential current generator 462, which may present challenges in implementations based on CMOS technologies. Such circuits may be complex, requiring unacceptable amount of area and power. An alternative embodiment which overcomes such disadvantages (by using linear components) is described below.

6. Linear Countering Circuit

Figure 5:
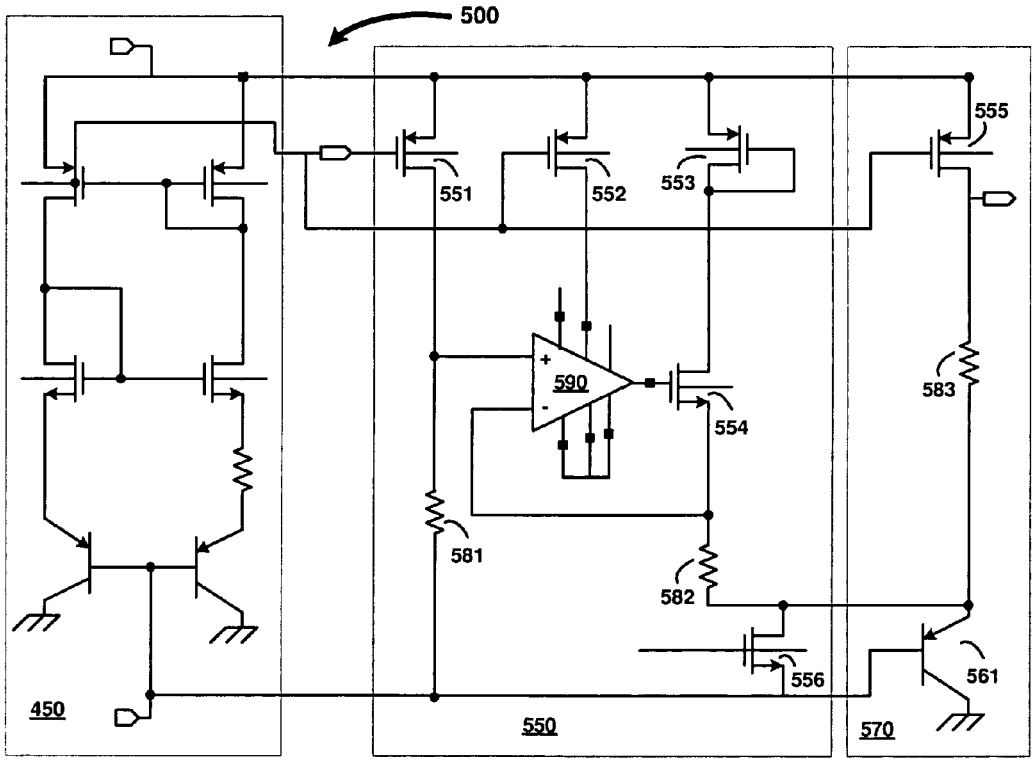
FIG. 5 is a circuit diagram illustrating the details of a voltage generation circuit in an alternative embodiment of the present invention.

An alternative embodiment implements the correction circuit using linear components, which would iteratively correct Vbe by approximate linear corrections, as described now with reference to FIG. 5. The components/operation of voltage generation circuit 500 (of FIG. 5) is described with reference to similar components/operation of voltage generation circuit 400 (of FIG. 4) for conciseness.

Voltage generation circuit 500 is shown containing PTAT generator 550, operational amplifier 590, CMOS transistors 551-556, resistors 581-583, bipolar transistor 561 and final stage 570. PTAT generator 550 and final stage 570 operates similar to PTAT generator 450 and final stage 470 (except for Icorrection, as described below). The sense mechanism to find deviations in Vbe and correcting for them is similar to the sense mechanism of FIG. 4 wherein a process-invariant PTAT voltage is used to sense the variations in Vbe due to process.

Deviation of Vbe from the nominal value is provided as feedback through resistor 582 to the inverting terminal of operational amplifier 590. The amplifier has a virtual short at its inputs (due to feedback) and therefore the current through resistor 582 is proportional to the difference between a PTAT voltage and the base-emitter voltage Vbe of transistor 561. This causes an increased amount (proportionate to the magnitude by which absolute value of Vbe is less than its nominal value) of Icorrection to be injected into the emitter terminal of transistor 561. The adjustment causes Vbe to move in the direction of its desired value.

Transistor 556 provides a mechanism to control the fraction of the current received from 582, which is provided as the correction current (Icurrent). Transistor 556 is biased by an appropriate biasing voltage.

Since the correction current is linearly proportional to the variation in Vbe and the correction mechanism in transistor 561 is logarithmic, this correction is not as accurate as in FIG. 4. However, it provides sufficient correction to preclude the use of trim etc., for most cases and is therefore often useful. As may be appreciated, the circuit of FIG. 5 is implemented using components commonly available in CMOS technologies only, which present fewer challenges at least from a fabrication standpoint. Furthermore, as a desired resistance value (for each of resistors 481 and 581) can be precisely attained independent of the process variations, desired pre-specified value for Vbe and thus Vref, can also be attained for reasons noted above.

Furthermore, due to the adaptive generation of the correction current (Icorrection) (and since no manual testing/configuration is required for each fabricated integrated circuit), the overall effort/cost to fabricate integrated circuits is reduced. In comparison to the prior embodiment of FIG. 2, the circuits of FIGS. 4 and 5 may require reduced space and cost, due to the fewer components required.

7. Conclusion

While various embodiments of the present invention have been described above, it should be understood that they have been presented by way of example only, and not limitation. Thus, the breadth and scope of the present invention should not be limited by any of the above described exemplary embodiments, but should be defined only in accordance with the following claims and their equivalents.

What is claimed is:

1. An integrated circuit comprising:

a component receiving a reference signal; and a reference generation circuit generating said reference signal based on a bandgap reference, said reference signal depending on a first voltage present across a junction present in a transistor, said first voltage depending on a fabrication process used to implement said integrated circuit, said reference generation circuit adjusting said first voltage to a pre-specified value irrespective of variations in said fabrication such that a strength of said reference signal is invariant of said fabrication process, wherein said reference generation circuit adjusts said first voltage adaptively without requiring user inputs representing corrections required due to said variations in said fabrication process.

2. The integrated circuit of claim 1, wherein said reference signal comprises a voltage signal and said reference generation circuit comprises a voltage generation circuit.

3. The integrated circuit of claim 2, wherein said voltage generation circuit comprises:

said junction, wherein said junction generates said first voltage which can deviate from a nominal value across different integrated circuits due to variation in said fabrication process; and a countering circuit injecting a correction current into said junction to change said first voltage to said nominal value.

4. The integrated circuit of claim 3, wherein said transistor comprises a first bipolar junction transistor.

5. The integrated circuit of claim 4, wherein said junction comprises a base to emitter junction of said first bipolar transistor.

6. An integrated circuit comprising:

a component receiving a reference signal, wherein said reference signal comprises a voltage signal; and a reference generation circuit generating said reference signal based on a bandgap reference, said reference signal depending on a first voltage present across said junction of a first bipolar transistor, said first voltage depending on a fabrication process used to implement said integrated circuit, said reference generation circuit adaptively adjusting a strength of said reference signal to a pre-specified value irrespective of variations in said fabrication, wherein said reference generation circuit comprises a voltage generation circuit comprising:

a junction generating said first voltage which can deviate from a nominal value across different integrated circuits due to variation in said fabrication process; and a countering circuit injecting a correction current into said junction to change said first voltage to said nominal value, said countering circuit comprising:

a second bipolar junction transistor providing a second voltage;

an operational amplifier receiving said second voltage on one terminal and a proportional to absolute temperature (PTAT) voltage on another terminal, which is proportionate to an ambient temperature, wherein said correction current is generated from an output generated by said operational amplifier.

7. The integrated circuit of claim 6, wherein said countering circuit further comprises:

an exponential current generator receiving on an input a voltage signal proportionate to said output generated by said operational amplifier, said correction current being generated on an output terminal of said exponential current generator, wherein said output terminal is connected to an emitter terminal of said first bipolar transistor.

8. The integrated circuit of claim 6, wherein said countering circuit further comprises:

a resistor being connected to one of the terminals of said junction; and said operational amplifier receiving said first voltage as said second voltage via said resistor on said one terminal and said proportional to absolute temperature (PTAT) voltage on said another terminal, said PTAT voltage being proportionate to said ambient temperature, wherein said correction current is generated from said output of said operational amplifier.

9. The integrated circuit of claim 8, wherein said resistor is coupled to said output of said operational amplifier.

10. The integrated circuit of claim 9, wherein said countering circuit further comprises:

a third transistor coupled between said output of said operational amplifier and said resistor, said third transistor sourcing current from a power supply.

11. The integrated circuit of claim 6, further comprising:

a PTAT circuit generating a second current proportionate to said ambient temperature;

a last stage comprising said first bipolar junction transistor, a resistor and a third transistor, wherein said third transistor is designed to mirror said second current through said resistor, said resistor being coupled between said third transistor and said first bipolar transistor.

12. A voltage generation circuit generating a reference voltage having a pre-specified value irrespective of variations in fabrication of said voltage generation circuit, said voltage generation circuit comprising:

a first operational amplifier having an inverting terminal and a non-inverting terminal as inputs and having an output terminal at which said reference voltage is generated;

a first transistor having an emitter terminal connected to said non-inverting terminal, a base terminal and a collector terminal of said first transistor being connected to ground;

a second transistor having an emitter terminal connected to said inverting terminal through a first resistor, a base terminal and a collector terminal of said second transistor being connected to ground;

a second resistor connecting said non-inverting terminal to a first node;

a third resistor connecting said first node to said inverting terminal;

a fourth resistor connecting said first node to said output terminal; and a countering circuit injecting a correction current into a base-to-emitter junction of said first transistor to change a first voltage across said base-to-emitter junction to a corresponding nominal value such that said reference voltage is maintained at said pre-specified value.

13. The voltage generation circuit of claim 12, wherein said countering circuit comprises:

a third transistor providing a second voltage;

a second operational amplifier receiving said second voltage on one terminal and a proportional to absolute temperature (PTAT) voltage on another terminal, which is proportionate to an ambient temperature, wherein said correction current is generated from an output generated by said second operational amplifier.

14. The voltage generation circuit of claim 13, wherein said countering circuit further comprises:

an exponential current generator receiving on an input a voltage signal proportionate to said output generated by said second operational amplifier, said correction current being generated on an output terminal of said exponential current generator, wherein said output terminal is connected to an emitter terminal of said first transistor.

15. The voltage generation circuit of claim 12, wherein said countering circuit comprises:

a second operational amplifier receiving a proportional to absolute temperature (PTAT) voltage on a non-inverting terminal, said PTAT voltage being proportionate to an ambient temperature;

a fifth resistor being connected between said emitter terminal of the said first transistor and inverting terminal of said second operational amplifier, wherein said correction current is generated from an output of said second operational amplifier.

16. The voltage generation circuit of claim 15, wherein said countering circuit further comprises:

a third transistor coupled between said output of said second operational amplifier and said fifth resistor, said third transistor sourcing current from a power supply.

17. A method of generating a reference signal in an integrated circuit, said method comprising:

generating a junction voltage across a junction present in a transistor, wherein a bandgap reference is available in said junction;

generating said reference signal based on said junction voltage; and adaptively adjusting a strength of said junction voltage to a pre-specified value without requiring user inputs representing corrections required due to said variations in said fabrication process used to implement said integrated circuit such that said reference signal has a pre-specified strength irrespective of said variations.

18. The method of claim 17, wherein said adaptively adjusting comprises injecting a correction current into said junction, wherein a magnitude of said correction current has a positive correlation with a deviation of a strength of said junction voltage from said pre-specified value.

* * * * *